US006976828B2

(12) United States Patent
Godichon et al.

(10) Patent No.: US 6,976,828 B2
(45) Date of Patent: Dec. 20, 2005

(54) CENTRIFUGAL WHEEL

(75) Inventors: Alain François Emile Godichon, Saint Remy (FR); Pierre Jacques François Grassi, Chatenoy le Royal (FR); Sylvain Georges Raymond Guillemin, Chalon-sur-Saône (FR)

(73) Assignee: Flakt Solyvent-Ventec, Cedex (FR)

( * ) Notice: Subject to any disclaimer, the term of this patent is extended or adjusted under 35 U.S.C. 154(b) by 107 days.

(21) Appl. No.: 10/487,699

(22) PCT Filed: Oct. 3, 2002

(86) PCT No.: PCT/FR02/03378

§ 371 (c)(1),
(2), (4) Date: Feb. 25, 2004

(87) PCT Pub. No.: WO03/031824

PCT Pub. Date: Apr. 17, 2003

(65) Prior Publication Data

US 2004/0241000 A1 Dec. 2, 2004

(30) Foreign Application Priority Data

Oct. 5, 2001 (FR) ..... 01 13013

(51) Int. Cl.[7] ..... F04D 29/26
(52) U.S. Cl. ..... 416/183; 416/223 B; 416/186 R
(58) Field of Search ..... 416/182, 181, 416/224, 223 B, 244 A, 204 A, 214 A, 183, 416/186 R; 415/12, 198.1

(56) References Cited

U.S. PATENT DOCUMENTS

| | | | | |
|---|---|---|---|---|
| 1,427,391 | A * | 8/1922 | Otto | 416/183 |
| 2,401,206 | A * | 5/1946 | Rijswijk | 416/186 R |
| 4,125,344 | A * | 11/1978 | Tiefenbacher | 416/183 |
| 4,647,271 | A | 3/1987 | Nagai et al. | 416/186 R |
| 4,958,987 | A * | 9/1990 | Billingsley | 416/213 A |
| 6,592,329 | B1 * | 7/2003 | Hirose et al. | 416/203 |

FOREIGN PATENT DOCUMENTS

| | | |
|---|---|---|
| CH | 416921 | 7/1966 |
| EP | 0942174 | 9/1999 |
| FR | 2504209 | 10/1982 |

* cited by examiner

*Primary Examiner*—Edward K. Look
*Assistant Examiner*—Richard Edgar
(74) *Attorney, Agent, or Firm*—James W. Kayden; Thomas, Kayden, Horstemeyer & Risley, LLP

(57) ABSTRACT

A centrifugal compressor wheel including a metal hub (2) for connecting to a drive shaft (3), an inlet plate (4) and an outlet plate (5) fixed to the metal hub (2), and a plurality of blades (7), each blade having a beginning and a peripheral portion (7*b*), fixed between the inner plate (4) and the outer plate (5). The wheel further includes an annular metal insert (8) integrated in the central portion of the wheel at a periphery of the hub (2), the annular metal insert (8) having metal elements (7A) forming the beginnings of the blades of the wheel. The inlet plate (4), the outlet plate (5), and the peripheral portions (7B) of the blades are made of a composite material, thereby constituting a composite portion of the wheel.

9 Claims, 2 Drawing Sheets

CENTRIFUGAL WHEEL

TECHNICAL FIELD

The present invention relates to the technical field of blower wheels or fan wheels or centrifugal compressor wheels for fitting to devices of the fan or centrifugal compressor type.

The present invention relates to a centrifugal compressor wheel comprising a metal hub for connecting to a drive shaft, and having fixed thereon an inlet plate and an outlet plate with fan blades being fixed between them, and the invention also relates to a method of manufacturing it.

PRIOR ART

Centrifugal compressor wheels for fitting to a variety of fans or compressors are well known and they generally comprise a series of blades disposed around an axis of rotation and interconnected by circularly symmetrical pieces which may be in the form a disk, a cone, or a ring, or which may be of any toroidal shape.

Proposals have already been made to make all or part of a centrifugal compressor wheel using composite materials, for example of low density, optionally reinforced by short or long reinforcing fibers. The use of composite materials that include carbon fibers, glass fibers, or indeed Kelvar fibers, or fibers of any other equivalent material is particularly advantageous for centrifugal compressor wheels in which stresses are due essentially to centrifugal forces.

Although composite materials have been used for making all or part of a centrifugal compressor wheel, such use has remained limited because of the cost of composite materials themselves, and because of the difficulty in making fan wheels out of composite materials. Known techniques for making composite centrifugal wheels generally rely on a technique of injecting resin into an appropriate mold, the mold already containing the reinforcing fibers that are to reinforce the entire structure of the compressor wheel. Unfortunately, it turns out to be very difficult to keep the reinforcing fibers in a desired configuration during the injection operation, thereby making the manufacturing technique complex and difficult, by multiplying the number of precautions that need to be taken. Furthermore, that can lead to parts being made that are of reduced strength, particularly in the fan blades.

Another factor limiting generalized use of composite materials in compressor wheels lies in the need to have tooling that is specific and therefore expensive.

Finally, although parts made out of composite materials can be very strong, it nevertheless turns out that they possess stiffness that usually remains inferior to the stiffness of parts made out of other materials that are commonly used in this field, and in particular parts made of steel. This is due in particular to the anisotropy of composite materials. In the field of fan devices, and for given speed of rotation, this leads to the composite wheels deforming more than similar wheels made of steel. In particular, it turns out that centrifugal compressor wheels made of composite material can lead to deformation that is large enough to lead to the front plate of the wheel rubbing against the inlet air guide. That phenomenon is particularly troublesome with wheels of great width (ratio of the inlet width of the blade divided by the diameter of the wheels greater than 0.2, or even for narrower wheels that rotate with high peripheral speed, greater than 150 meters per second (m/s)).

SUMMARY OF THE INVENTION

Consequently, the object of the invention is to remedy the various drawbacks listed above and to provide a novel centrifugal compressor wheel made of composite material and possessing improved ability to withstand deformation.

Another object of the invention is to propose a novel centrifugal compressor wheel possessing improved ability to withstand angular deformation about an axis perpendicular to the axis of rotation.

Another object of the invention is to propose a novel centrifugal compressor wheel of simplified design.

Another object of the invention is to propose a novel centrifugal compressor wheel that is particularly simple to assemble and mount.

Another object of the invention is to propose a novel centrifugal compressor wheel that is good at withstanding external attacks.

Another object of the invention is to provide a novel method of manufacturing a composite centrifugal compressor wheel which is particularly simple to implement and perform.

The objects given to the invention are achieved by means of a centrifugal compressor wheel including a metal hub for connecting to a drive shaft, an inlet plate and an outlet plate fixed to the metal hub, and a plurality of blades, each blade having a beginning and a peripheral portion, fixed between the inner plate and the outer plate, the wheel further including an annular metal insert integrated in the central portion of the wheel at a periphery of the hub, the annular metal insert having metal elements forming the beginnings of the blades of the wheel, wherein the inlet plate, the outlet plate, and peripheral portions of the blades are made of a composite material, thereby constituting a composite portion of the wheel.

The objects given to the invention are also achieved by means of a method of manufacturing a centrifugal compressor wheel including a metal hub having an inlet plate and an outlet plate fixed thereon, and a plurality of blades being fixed therebetween, the method including:

a) making a metal insert including a plurality of metal elements, each metal element forming a beginning of a blade of the wheel; and b) assembling a composite portion of the wheel directly on the insert, the composite portion being formed by the inlet plate, the outlet plate, and by peripheral portions of the blades.

BRIEF DESCRIPTION OF THE DRAWINGS

Other advantages and objects of the invention appear in greater detail in reading the following description, and with reference to the accompanying drawings provided purely by way of non-limiting explanation, and in which.

BEST METHOD OF PERFORMING THE INVENTION

Figure 5:
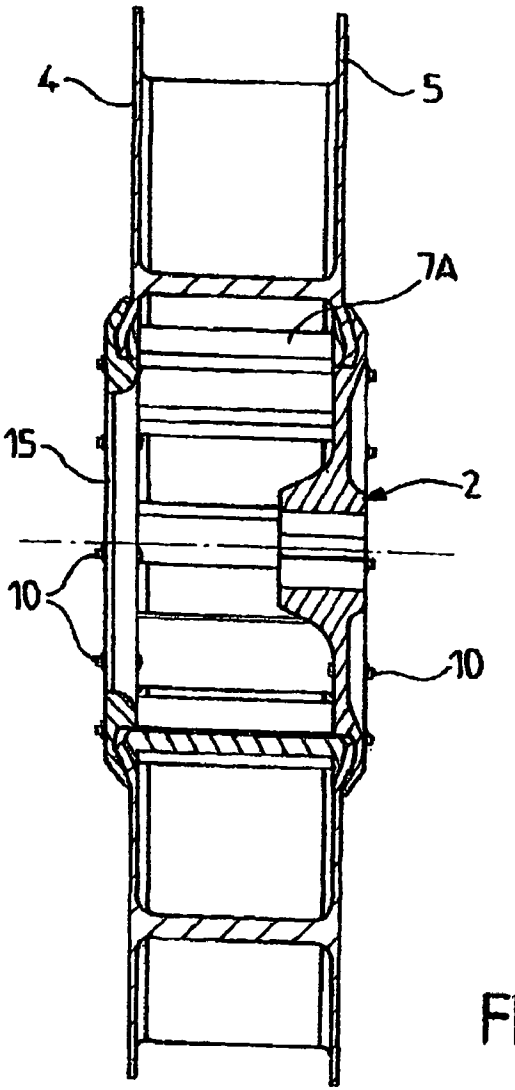
FIG. 5 is a cross-section view of a compressor wheel in accordance with the invention, showing a detail of how a compressor wheel having two parallel plates is embodied.
Figure 1:
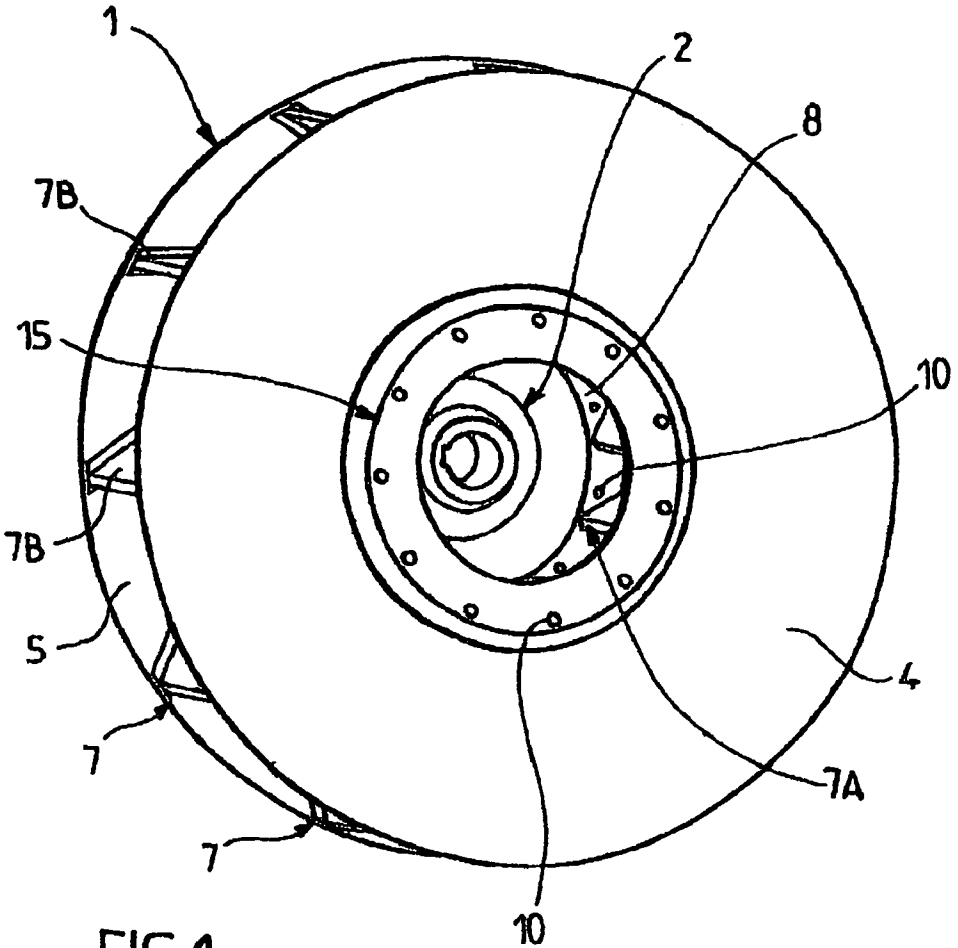
FIG. 1 is a perspective view showing an embodiment of a centrifugal compressor wheel in accordance with the invention.

As shown in FIGS. 1 to 5, the device of the invention includes a centrifugal compressor wheel 1 itself having a metal hub 2 for connection by any known means to a drive shaft 3. The centrifugal compressor wheel 1 is made up of two plates, e.g. circular plates 4 and 5 provided with respective central openings and constituting respectively an inlet plate 4 and an outlet plate 5 for the flow of fluid (generally air) that is to be moved and passed through the fan.

In conventional manner, a series of blades 7 is interposed between the inlet and outlet plates 4 and 5, thus forming a spacer. The blades 7 are usually disposed in an inclined configuration although they are sometimes purely radial, with this depending on the specific features and the field of application of the centrifugal compressor wheel 1.

Figure 2:
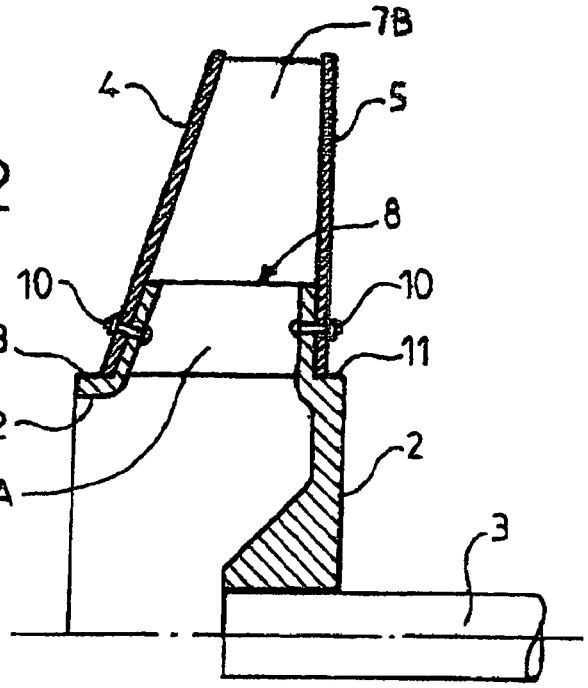
FIG. 2 is a fragmentary cross-section view of a first variant embodiment in accordance with the invention.
Figure 3:
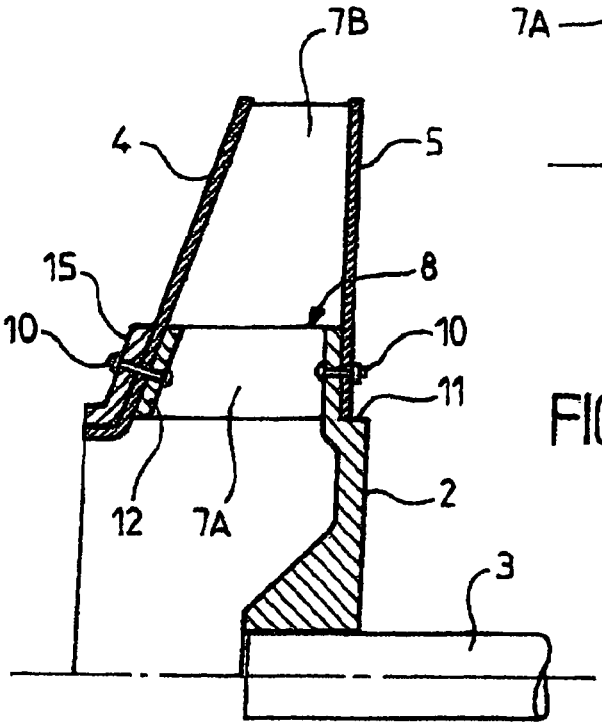
FIG. 3 is a fragmentary cross-section view showing another variant embodiment of the invention.
Figure 4:
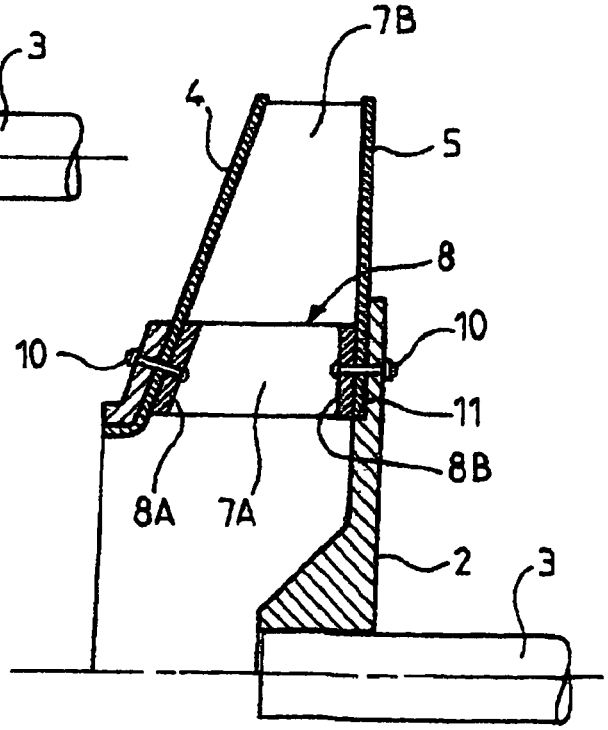
FIG. 4 is a fragmentary cross-section view showing an additional variant embodiment of the invention.

The inlet and outlet plates 4 and 5 may be plane, or they may be conical in shape, or they may be of any other circularly symmetrical shape about the axis of the wheel, as shown in FIGS. 2 to 5, and they may be associated in pairs equally well to form a pair of parallel plates (FIG. 5), or to form a pair of plates associating a conical inlet plate 4 with a plane outlet plate (FIGS. 2 to 4). Naturally, both of the plates 4 and 5 may also be conical without thereby going beyond the ambit of the invention.

According to an important characteristic of the invention, the centrifugal compressor wheel 1 includes an annular metal insert 8 which is integrated in the central portion of the compressor wheel 1 at the periphery of the hub 2 and in the vicinity of the central openings in the plates 4 and 5, and which comprises metal elements 7A forming the beginnings of the wheel blades, while the inlet plate 4, and the outlet plate 5, together with the remaining portions and the peripheries 7B of the blades are made of composite material in order to constitute the composite portion of said wheel.

The metal elements 7A thus form the leading edges of the blades 7, which blades are thus made up of two sections in line with each other so as to constitute each complete blade, i.e. an inner section formed by the metal elements 7A and a peripheral section of composite material 7B.

Because of this specific configuration, deformation of the composite wheel is greatly reduced, thereby increasing the general robustness of the wheel, in particular for wheels rotating at a high peripheral speed, while benefitting from the high strength of the metal material constituting the leading edges of the blades 7. It is principally at the leading edges of the blades where attack from solid particles or liquids conveyed by the fluid being sucked in is at its maximum.

As shown in FIGS. 2 to 5, the metal insert 8 is mounted between the two plates 4 and 5 in such a manner as to be capable of supporting the composite portion over its entire transverse width.

By means of such a configuration, angular deformation about an axis perpendicular to the axis of rotation is significantly reduced.

In a first variant embodiment as shown in FIG. 4, the metal insert 8 is formed by an annular part independent of the hub 2 and fitted thereto by any conventional means, for example by welding or by means of bolts.

In this variant, the metal insert 8 is formed by two annular bodies 8A and 8B in the form of plates concentric with the hub 2, these two annular bodies 8A and 8B being spaced apart from each other. Metal elements 7A forming the metal beginnings of the blades 7 are disposed between these plates and are interposed at regular intervals. Each annular body 8A, 8B is secured to a corresponding plate 4, 5 by fastener means, e.g. by a set of bolts 10 serving on one side to hold and support the hub 2 and the outlet plate 5, and on the other side to interconnect the annular body 8A and the inlet plate 4. As shown in FIG. 4, the hub 2 may advantageously include in its outer peripheral portion an annular flat 11 enabling the outlet plate 5 to be positioned radially relative to the axis of the drive shaft 3. As shown in FIG. 4, the annular flat 11 is provided on the inside face of the hub 2 facing the inlet face 4.

In a variant embodiment, as shown in FIGS. 2 and 3, for example, the metal insert 8 is an integral portion of the hub 2 so that together they form a single piece. Such an embodiment naturally makes manufacture and assembly easier. In this variant, the hub 2 includes an annular flat 11 towards its peripheral outer portion and formed in the outside face of the hub so as to constitute a step on which the outlet plate 5 rests. The front plate 4 is supported by the annular front portion 12 of the hub 2, which advantageously includes a circular rim 13 on which the inlet plate 4 rests in peripheral manner, as shown in FIG. 2. In this way, the composite portion of the centrifugal compressor wheel 1 is well supported by the metal hub 2 over its entire width. As in the other variants, fastening is performed by a set of bolts 10, or by any other equivalent means well known to the person skilled in the art.

As shown in FIG. 3, the composite wheel of the invention may include a metal annular reinforcement piece 15 mounted against the outside face of one of the plates, and in this particular case against the inlet plate 4. The metal annular reinforcement piece 15 is assembled to the metal insert 8, and in this case to the annular portion 12 of the hub 2, by means passing through the plate 4 in order to support the composite portion. As shown in this variant, the metal annular reinforcement piece 15 is mounted on and against the outside of the inlet plate 5, it being understood that in a variant and to further reinforce the robustness of the assembly, a second metal annular reinforcement piece 15 could be mounted against the outlet plate 5.

This metal annular reinforcement piece 15 is fastened in conventional manner by means of bolts 10.

The metal insert 8 may be made using techniques that are well known to the person skilled in the art, for example by machining or by casting, or it may be built up from distinct parts that are assembled together by welding.

The composite portion of the compressor wheel of the invention may be made either by molding composite materials, or by conventional methods that rely on assembling together various components or elements of composite material that are interconnected during the successive steps of a mechanical method or of a method that makes use of a series of steps involving adhesive. The material constituting the composite portion of the wheel is determined as a function of the method of manufacture that is to be used.

According to a characteristic of the invention, the method of manufacturing a centrifugal compressor wheel including a metal hub having an inlet plate and an outlet plate fixed thereon, and a plurality of blades being fixed therebetween, the method including:

a) a metal insert is made which includes a plurality of metal elements constituting beginning portions of the blades of the wheel; and b) a suitable method is used for assembling directly on the insert a composite wheel portion formed by the inlet plate, the outlet plate, and the peripheral portions of the blades.

Fastening, i.e. bonding or joining the metal insert to the composite portion can be performed mechanically using any conventional fastening means, with the composite portion then being made separately during an earlier step.

Advantageously, the fastening step b) is performed simultaneously with the operation of making the composite portion by molding the composite portion of the wheel directly on the metal insert. The molding operation is performed by overmolding one or more composite materials.

Such a method naturally simplifies manufacture of the wheel insofar as the step of directly overmolding composite material on the metal insert simplifies manufacture to a great extent.

There are numerous advantages in making a composite wheel associating a composite material structure forming the periphery of the wheel with a metal structure forming the central portion of the wheel. Thus, deformation is reduced, in particular angular deformation about an axis perpendicular to the axis of rotation, with this being achieved by the relative dimensions given to the circularly symmetrical pieces so that their radial expansion is caused to be similar under the effect of the centrifugal forces to which they are subjected.

The metal insert thus constitutes a support for the centrifugal forces applied to the wheel, and is suitable for reducing deformation.

For compressor wheels presenting front and back plates that are plane and parallel (FIG. 5), the compressor wheel can be entirely symmetrical, thus making it easier to manufacture, reducing the cost of tooling, and also presenting an advantage in terms of reducing deformation.

Finally, integrating a metal structure in the suction, inlet zone of the composite wheel provides excellent protection to the composite portions of the wheel against damaging agents such as solid or liquid particles conveyed by the fluid being sucked in.

SUSCEPTIBILITY OF INDUSTRIAL APPLICATION

The industrial application of the invention lies in the design and manufacture of centrifugal compressors or fans.

What is claimed is:

1. A centrifugal compressor wheel (1) including a metal hub (2) for connecting to a drive shaft (3), an inlet plate (4) and an outlet plate (5) fixed to the metal hub (2), and a plurality of blades (7), each blade having a beginning and a peripheral portion (7B), fixed between the inner plate (4) and the outer plate (5), the wheel further comprising:

an annular metal insert (8) integrated in the central portion of the wheel (1) at a periphery of the hub (2), the annular metal insert (8) having metal elements (7A) forming the beginnings of the blades (7) of the wheel (1);

wherein the inlet plate (4), the outlet plate (5), and the peripheral portions (7B) of the blades (7) are made of a composite material, thereby constituting a composite portion of the wheel.

2. The wheel according to claim 1, wherein the metal insert (8) is mounted between the inlet plate (4) and the outlet plate (5) and supports the composite portion over the entire width of the composite portion.

3. The wheel according to claim 1, wherein the metal insert (8) further comprises an independent annular piece and is fitted to the hub (2).

4. The wheel according to claim 3, wherein the metal insert (8) is formed by a first annular body (8A) and a second annular body (8B) that are spaced apart from each other with the metal elements (7A) forming the metal beginnings of the blades being disposed therebetween.

5. The wheel according to claim 1, wherein the metal insert (8) is an integral portion of the hub (2) such that the metal insert (8) and the hub (2) form a single piece.

6. The wheel according to claim 1, further comprising a metal annular reinforcement piece (15) fastened to the metal insert (8) such that a portion of the composite portion is secured between the metal annular reinforcement piece (15) and the metal insert (8).

7. The wheel according to claim 6, wherein the annular reinforcement piece (15) is mounted on and adjacent an outside face of the inlet plate (4).

8. A method of manufacturing a centrifugal compressor wheel including a metal hub having an inlet plate and an outlet plate fixed thereon, and a plurality of blades being fixed therebetween, the method comprising:

a) making a metal insert including a plurality of metal elements, each metal element forming a beginning of a blade of the wheel; and b) assembling a composite portion of the wheel directly on the insert, the composite portion being formed by the inlet plate, the outlet plate, and by peripheral portions of the plurality of blades.

9. The method according to claim 8, wherein assembling a composite portion further comprises molding the composite portion of the wheel directly on the metal insert.

* * * * *